US006336523B1

(12) United States Patent
Ozeki et al.

(10) Patent No.: US 6,336,523 B1
(45) Date of Patent: Jan. 8, 2002

(54) ELEVATOR HAVING AN AUXILIARY CONTROL DEVICE MOUNTED IN THE ELEVATOR SHAFT IN THE VICINITY OF A DOOR POCKET

(75) Inventors: Akihiro Ozeki, Tokyo; Yutaka Nakajima, Saitama-ken, both of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/391,410

(22) Filed: Sep. 8, 1999

(30) Foreign Application Priority Data

Sep. 8, 1998 (JP) ..... 10-253990
Oct. 30, 1998 (JP) ..... 10-309962

(51) Int. Cl.[7] ..... B66B 3/00
(52) U.S. Cl. ..... 187/391; 187/277
(58) Field of Search ..... 187/391, 392, 187/393, 414, 277

(56) References Cited

U.S. PATENT DOCUMENTS 5,740,888 A * 4/1998 Aulanko et al. ..... 187/336
5,971,109 A * 10/1999 Aulanko et al. ..... 187/263
6,076,638 A * 6/2000 Gertz ..... 187/414
6,148,962 A * 11/2000 Hakala et al. ..... 187/254

FOREIGN PATENT DOCUMENTS

| | | | |
|---|---|---|---|
| JP | 59-163270 | | 9/1984 |
| JP | 2-127387 | | 5/1990 |
| JP | 3-18569 A | * | 1/1991 |
| JP | 3-138277 A | * | 6/1991 |
| JP | 6-144726 A | * | 5/1994 |
| JP | 10-36022 A | * | 2/1998 |

* cited by examiner

*Primary Examiner*—Jonathan Salata
(74) *Attorney, Agent, or Firm*—Oblon, Spivak, McClelland, Maier & Neustadt, P.C.

(57) ABSTRACT

An elevator including a hoisting device configured to drive a cage installed in a shaft, a counter weight installed in the shaft, a cable configured to connect the counter weight and the cage via the hoisting device, a guide rail configured to guide the cage or the counter weight vertically, a controlling device installed in a door pocket, provided at a certain elevator hall and configured to control the operation of the cage, an auxiliary controlling device configured to operate the auxiliary function of the controlling device, provided in the vicinity of an elevator component provided in the vicinity of the door pocket of the elevator hall, where the controlling device is installed.

13 Claims, 15 Drawing Sheets

ELEVATOR HAVING AN AUXILIARY CONTROL DEVICE MOUNTED IN THE ELEVATOR SHAFT IN THE VICINITY OF A DOOR POCKET

CROSS REFERENCE TO RELATED APPLICATION

This application claims benefit of priority to Japanese Patent Application Nos. JP10-253990 filed Sep. 8, 1998 and JP10-309962 filed Oct. 30, 1998, the entire disclosure of which is incorporated by reference herein.

BACKGROUND OF THE INVENTION

1. Field of the Invention

The present invention relates to an elevator without a machine room (penthouse), and which does not require a machine room for installing a controlling device.

2. Description of the Background

In general, an elevator is composed of a cage for accommodating passengers, a hoisting device for driving the cage, a counter weight for balancing the weight, a cable for connecting the cage and the counter weight via the hoisting device, and a controlling device for controlling the overall operation of the elevator. Such an elevator is referred to as a rope type elevator.

As to the space in a building for installing such a rope type elevator, in general, a shaft wherein the cage moves up and down is provided in the building, and an elevator machine room for storing the hoisting device and the controlling device (a control panel) is provided in an annex room at the uppermost part of the shaft. The controlling device necessary for the control of the elevator, including other optional components, has been accommodated in the machine room. Therefore, the primary use of the machine room has been as a place to perform maintenance work on the controlling device.

However, in a condominium or high-rise apartment, a machine room with a sufficient size may not be obtained at the uppermost part of the building due to limitations placed on construction such as the right of light. In this case, a hydraulic type elevator, capable of installing the machine room in the building has been adopted.

However, even in the hydraulic type elevator, a space for the machine room is required in the building, which produces its own set of problems in that the noise and vibration in driving the elevator are significant compared with the rope type elevator, and odor is generated by the use of oil.

One approach to solve such problems is to install an elevator controlling system in the vicinity of an elevator hall or in a cage and store a hoisting device at the uppermost part or the lowermost part of a shaft. For example, the depth of a door pocket, which is an elevator door storing part, in some floors is made longer than that of the other floors to form a storage area for the elevator controlling system.

The storage area for storing the elevator controlling device is provided at the elevator hall side of the door pocket where the hall door is located. The hoisting device is made smaller and thinner so as to be placed in a spare space at the uppermost part or the lowermost part of the elevator shaft. As a result, a building space other than the shaft for moving the cage, is not required. This is referred to as an elevator without a machine room, which has been developed.

Japanese Patent Application Publications (Kokai) No. 59-163270 and No. 2-127387 disclose the controlling device stored in the door pocket of the elevator hall at a certain floor. As to the customer specification, options to be added are limited so that all the controlling device components can be stored basically in the door pocket. Storage spaces for some controlling devices not stored in the door pocket are secured individually in the shaft, and the like.

FIG. 1 is a longitudinal cross-sectional view of a non-prior art elevator shaft concurrently under development by the assignee of the present application for explaining the known elevator controlling system. FIG. 2 is a lateral cross-sectional view of the shaft of FIG. 1 viewed from the above to the below.

In the elevator controlling system shown in FIGS. 1 and 2, a hoisting device 31 drives a cage 32 and a counter weight 35 via a cable 34.

The cage 32 moves up and down along two guide rails 36A, 36B (the guide rail 36B is disposed vertically in the elevator shaft opposite the guide rail 36A). The counter weight 35 moves up and down along two counter weight guide rails 37A, 37B.

In order to omit the machine room, the hoisting device 31 is placed on and fixed with a hoisting device mounting base 47 fixed on the uppermost part of the cage guide rail 36A and the cable 34 lifts the cage 32 by two car sheaves 33. Similarly, the counter weight 35 is lifted up by a counter weight upper sheave 38. The cable 34 is fixed with the counter weight cable hitch 39 and a cage cable hitch (not illustrated). On the other hand, a controlling device 42, which governs the operation of the elevator, is stored and fixed in a door pocket 71 sized to store a hall door 41 in the open state.

According to the configuration. an elevator without a machine room can be realized.

The two car sheaves 33 are provided below the cage 32, with the cable 34 fixed by the cable hitch (not shown) at the upper part of the cage guide rail 36B. This is referred to as the 2:1 roping. By placing the hoisting device 31 and the counter weight 35 at the side surface of the cage 32 and adopting the above-mentioned 2:1 roping, the area of the shaft can be made smaller. As a result, the size of the shaft can be decided only with the size of the cage 32 and the size of the hoisting device 31.

On the other hand, in FIG. 3A showing the external appearance of an elevator hall jam 51 on the elevator hall side and FIG. 3B showing the cross-section on the elevator hall side, the elevator hall jamb 51 is provided with a controlling device access door 53 in the door pocket in which the hall door 41 is located, and the controlling device 42 is stored inside the access door 53. Moreover, a hall operation panel 52 is provided on the opposite side. An elevator user operates the elevator by pushing the call button of the hall operation panel 52.

In general, the controlling device door 53 is provided with a controlling device door key 56 so as not to be opened easily by a user. Further, an opening and closing detector 55 for detecting the opening or closing state of the door 53 is mounted on the controlling device 42.

However, according to the configuration, since the elevator controlling device 42 is mounted in the vicinity of the elevator hall used by an elevator user, if the controlling device door 53 provided in the jamb 51, and the like, is opened by mischief, and the like, not only the person who opens the controlling device door 53 but also the users in the cage may be endangered by mistaken or inappropriate operation of the controlling device 42. That is, if the power source in the controlling device 42 is switched off by mischief, the moving cage is stopped so that the users in the cage are confined.

However, on the other hand, the maintenance worker in maintaining the elevator operation needs to open the controlling device access door 53 to perform maintenance work.

Since the operation can be conducted in a machine room in a conventional rope type elevator, safe operation is allowed without unauthorized access by third persons.

However, since the controlling device 42 is disposed on the elevator hall, the maintenance worker is required to work in the environment where building users, that is, passengers and passers by, come and go, and this can be very dangerous. Since the controlling device 42 is usually applied with three phase voltages of about 200V, it is possible that a child may inadvertently approach the device and receive an electric shock, possibly also endangering the maintenance worker.

Thus, in order to prevent such problems, the controlling device door 53 is provided with the controlling device door key 56 so that a third person cannot easily open it.

Moreover, the opening and closing detector 55 for detecting the door state of opening or closing of the access door 53 and an operation circuit are provided so that the elevator is stopped when the controlling device access door 53 is opened for improving the security.

Next, an example of a circuit of a controlling device 42 installed at the uppermost elevator hall with the opening and closing detector 55 will be explained with reference to FIG. 4, which is a schematic block diagram of the controlling device 42.

The controlling device 42 is mainly composed of a power source section 57, a main circuit section 58 and a controlling circuit section 70. In the power source section 57, a power line 59 from the building is received by the main power source section 60 having a breaker, and the like, so that the power source is supplied to the controlling circuit section 70. and the like.

In the controlling circuit section 70, a CPU 61 having a 16 bit or 32 bit microcomputer is provided for control, and various devices are added to a bus 62 for administrating addresses and data. That is, controlling circuit section 70 includes a program memory section 72 of about 256 KB for storing a program for driving the CPU 61, a data memory section 63 of about 128 KB utilizing a RAM, and the like, for storing changing data, a specification data memory section 64 utilizing an electrically erasable memory device for storing data such as data related to the building and data on the speed or stoppage number, and the like, a signal input buffer 65 for converting an inputted external signal to a signal level readable by the CPU 61, and a signal output buffer 66 for outputting a signal dealt with by the CPU 61 to the outside.

On the other hand, the main circuit section 58 is composed of a speed controlling section 58A connected with the CPU 61 for smoothly driving the cage 32 and the main circuit driving section 58B for driving the hoisting device 31 with an element such as a transistor. The pulse signal generated by a pulse generator 73 is inputted to a position detecting section 69 and utilized to detect the position of the cage 32 or control the drive speed of the hoisting device 31.

A signal usually of about 24 VDC from the opening and closing detector 55 is inputted to the signal input buffer 65 and is converted to about 5 VDC in the signal input buffer 65 by a photo coupler, or the like, for the voltage transfer so as to be readable by the CPU 61 and stored in a register as an opening and closing detection signal.

The signal input buffer 65 and the signal output buffer 66 provide a high speed serial transmission for cutting down the number of lines, and exchange signals with the hall operation panels 52 at each floor via a serial transmission cable 67. A traveling cable 68 exchanges signals with the cage operation panel (not illustrated).

The traveling cable 68 includes the communication cable of an interphone 54 so that a passenger in the cage 32 can talk by the interphone 54 or to a building supervisor or the elevator maintenance company by pushing the call button (not illustrated).

According to the above-mentioned configuration and the controlling device 42, an elevator without a machine room can be provided.

In the above-mentioned conventional elevator without a machine room, the below-mentioned problems are involved.

(Problem 1)

Since a thin shape is demanded of a controlling device 42, only basic functions are accommodated therein. Therefore, when a customer specification not included in the basic functions is required, an auxiliary controlling device having at least one auxiliary controlling appliance such as an automatic landing device at the time of the service interruption, a monitor panel display device, a transformer for the air conditioner power source, an earthquake sensor, and the like, needs to be provided at a place other than the elevator hall storing part. As a representative installation place for the auxiliary controlling device, the use of the shaft where the cage 32 moves up and down is conceivable. However, a small size shaft is desired for installation in a building. Therefore, only a slight space is left at the uppermost part (top part) and the lowermost part (pit) of the shaft.

Moreover, for the installation of the auxiliary controlling device, the device needs to be fixed on the wall of the shaft, but depending on the structure of the building, sometimes a screw for the fixation cannot be mounted.

Furthermore, since the shaft itself is a highly humid environment, if the auxiliary controlling device is fixed on the shaft, water generated by dew condensation can enter into the device so as to cause damage to the device.

On the other hand, if the auxiliary controlling device is installed in the pit, there is a risk of inundation caused by a heavy rain, and thus it needs to be installed in a water proof box.

(Problem 2)

If an auxiliary controlling device is installed in the shaft, in general, it is difficult to separate lines provided between the controlling device 42 and the auxiliary controlling device such as signal lines including the above-mentioned high speed serial signal lines and a signal line of about 24 VDC, and an 100 VAC power source line. That is, there is no place for separating the electric lines for mounting the electric lines on the wall, besides, displacement of the lines caused by the passage of time cannot be avoided. Therefore, the operation of the high speed serial signals can be affected by noise. As a result, the operation of the elevator is affected as well, and in the case of an extremely strong noise, can be problematic.

(Problem 3)

If an auxiliary controlling device is installed at the top part of the shaft, it may be difficult to fix the device, and thus the device needs to have a 10 kg or less weight so that a worker can hold it by himself. Therefore, a heavy device should be installed at the pit, whereas Problem 1 exists.

On the other hand, in the above-mentioned conventional elevator, the convenience for easily conducting the checking operation of the controlling device 42 and any optionally added auxiliary controlling device optionally has not been considered.

SUMMARY OF THE INVENTION

Accordingly, an object of the present invention is to provide an elevator not limited by the structure of the building or the environment peculiar to the shaft, such as high humidity, in an elevator without a machine room and where the controlling unit is stored in the door pocket for storing the hall door.

A further object of the present invention is to provide an elevator allowing the safe and efficient pursuit of maintenance of the controlling device and having a controlling unit device and/or an auxiliary controlling unit installed in the shaft.

These and other objects are achieved according to the present invention by providing a new and improved elevator including a hoisting device configured to drive a cage installed in a shaft, a counter weight installed in the shaft, a cable configured to connect the counter weight and the cage via the hoisting device, a guide rail configured to guide the cage or the counter weight vertically, a controlling device installed in a door pocket, provided at a certain elevator hall and configured to control the operation of the cage, an auxiliary controlling device configured to operate an auxiliary function of the controlling device, provided in the vicinity of an elevator component provided in the vicinity of the door pocket of the elevator hall, where the controlling device is installed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
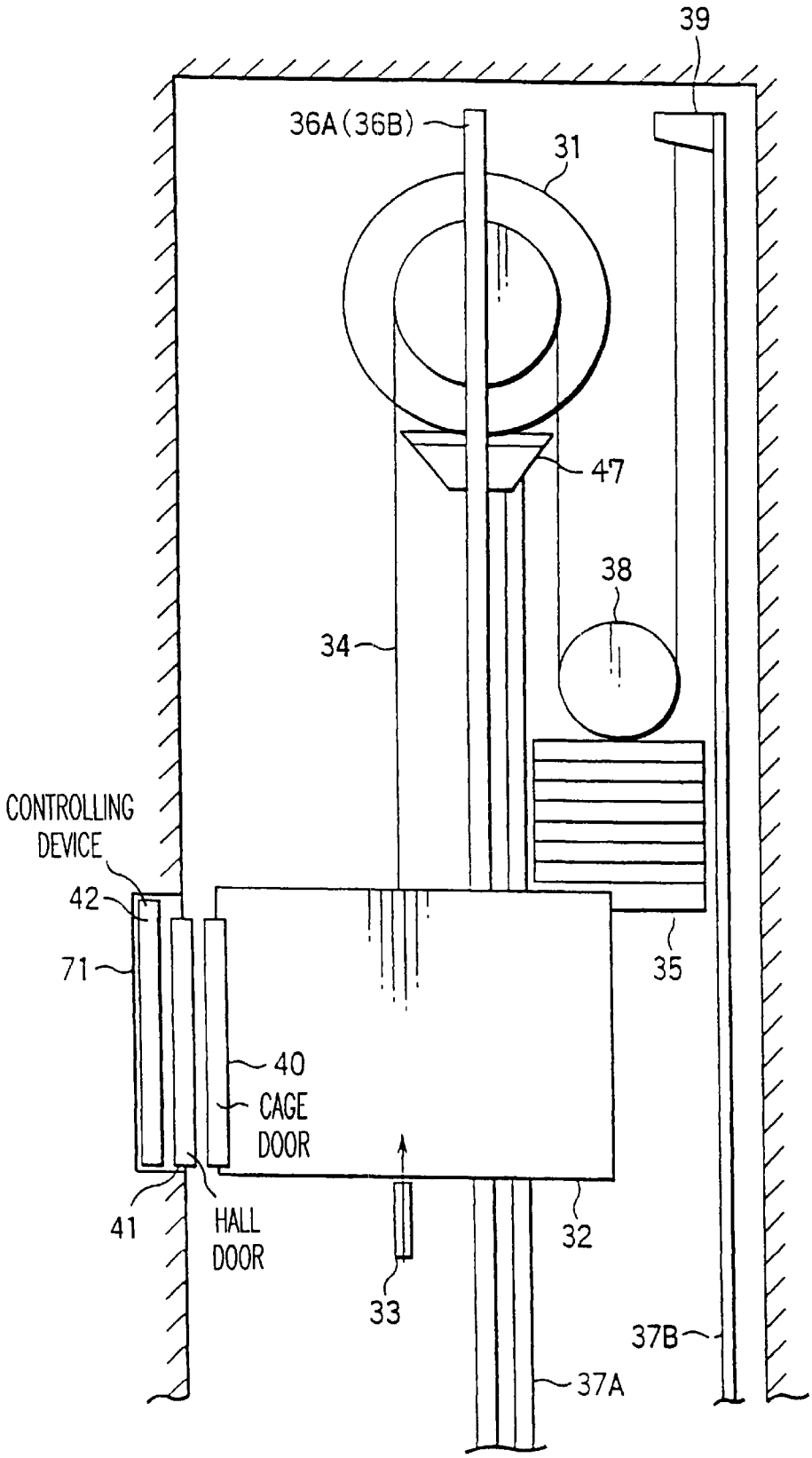
FIG. 1 is a longitudinal cross-sectional view of an elevator of a conventional elevator controlling system.
Figure 2:
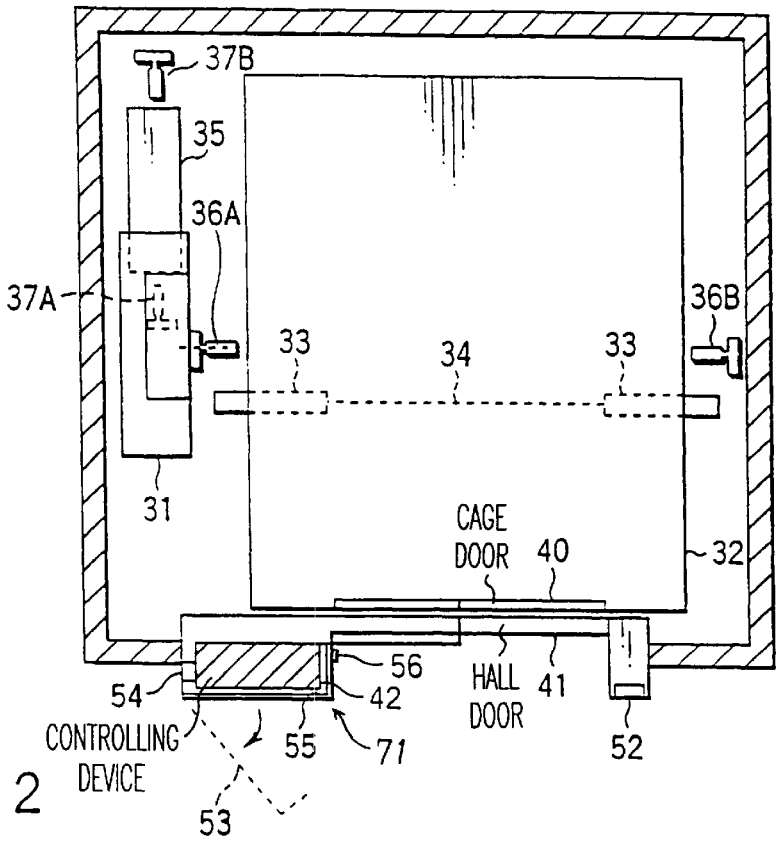
FIG. 2 is a lateral cross-sectional view of the elevator shaft of FIG. 1.
Figure 3A:
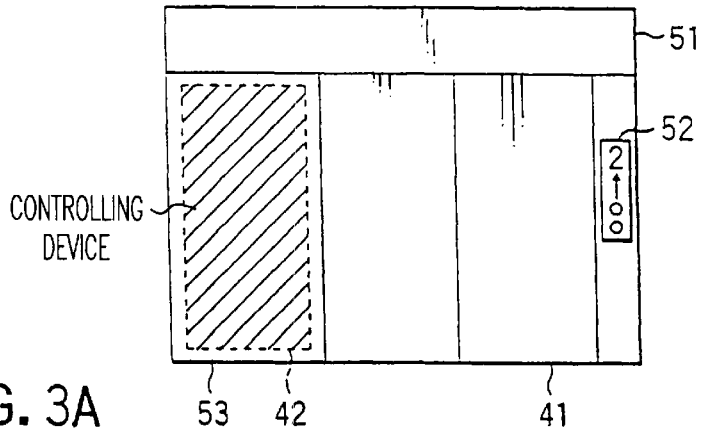
FIG. 3A PRIOR ART
FIG. 3A is a schematic front view showing an external appearance of the elevator hall of a conventional elevator controlling system.
Figure 3B:
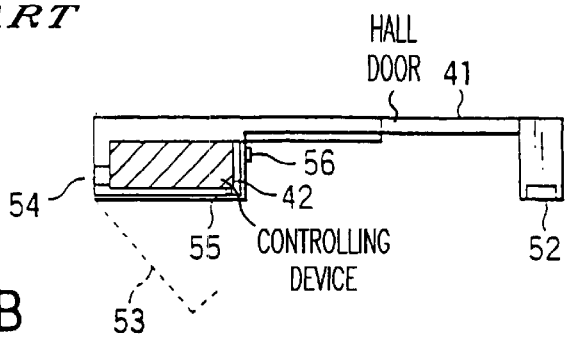
FIG. 3B PRIOR ART
FIG. 3B is a schematic cross-sectional view of FIG. 3A.
Figure 4:
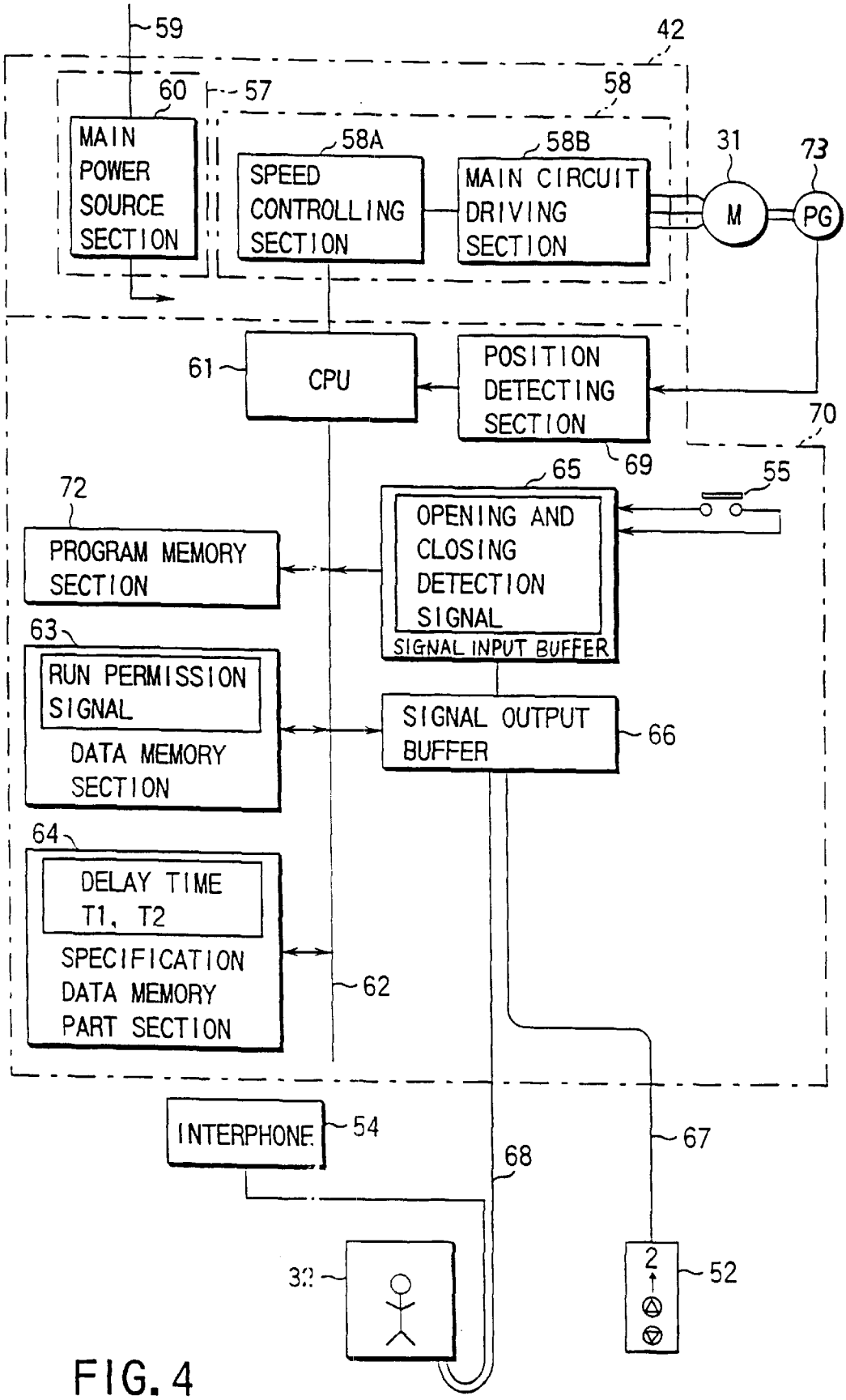
FIG. 4 is a schematic block diagram of a conventional elevator controlling system.
Figure 5:
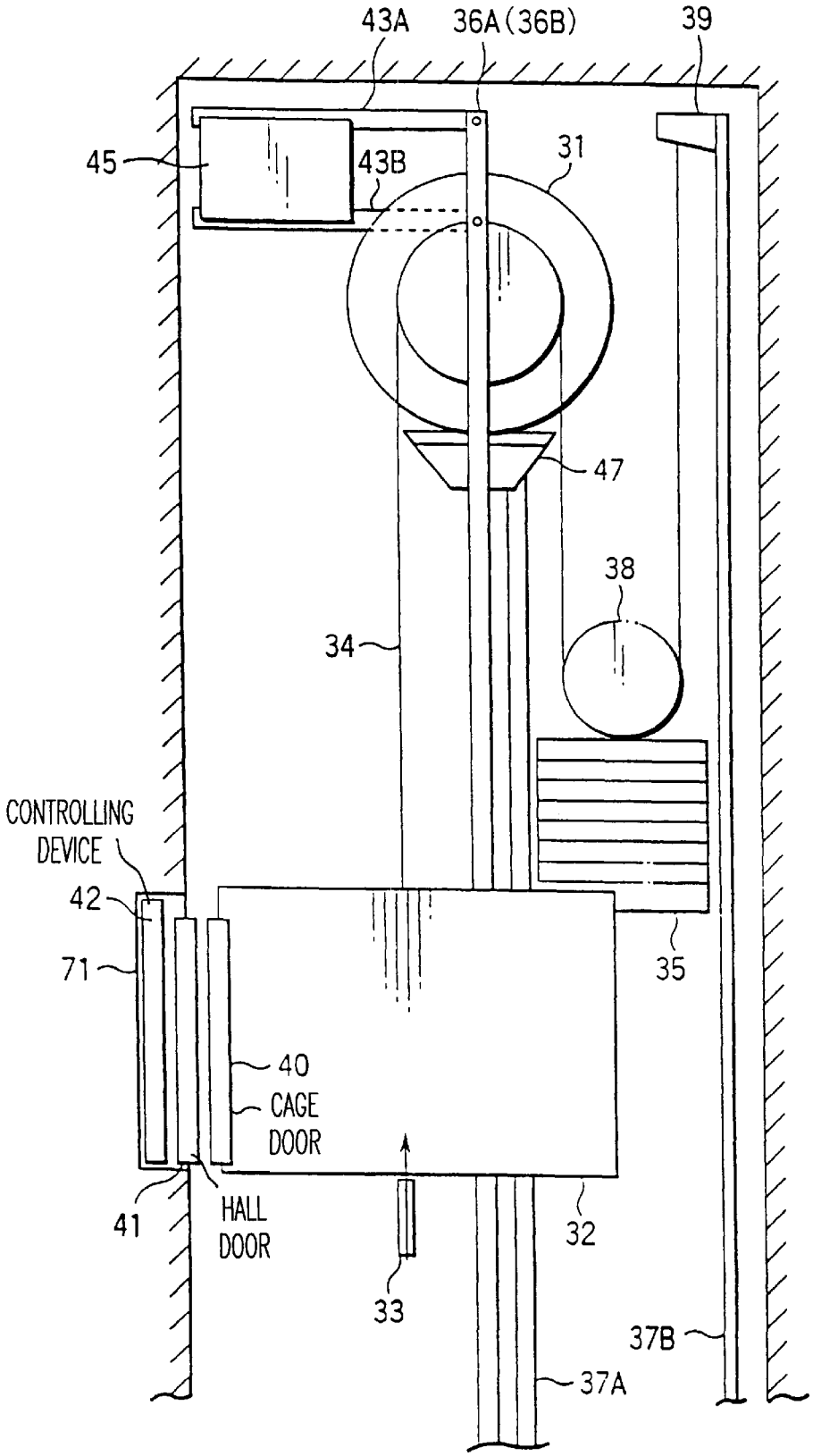
FIG. 5 is a longitudinal cross-sectional view of an elevator of a first embodiment of the present invention.
Figure 6:
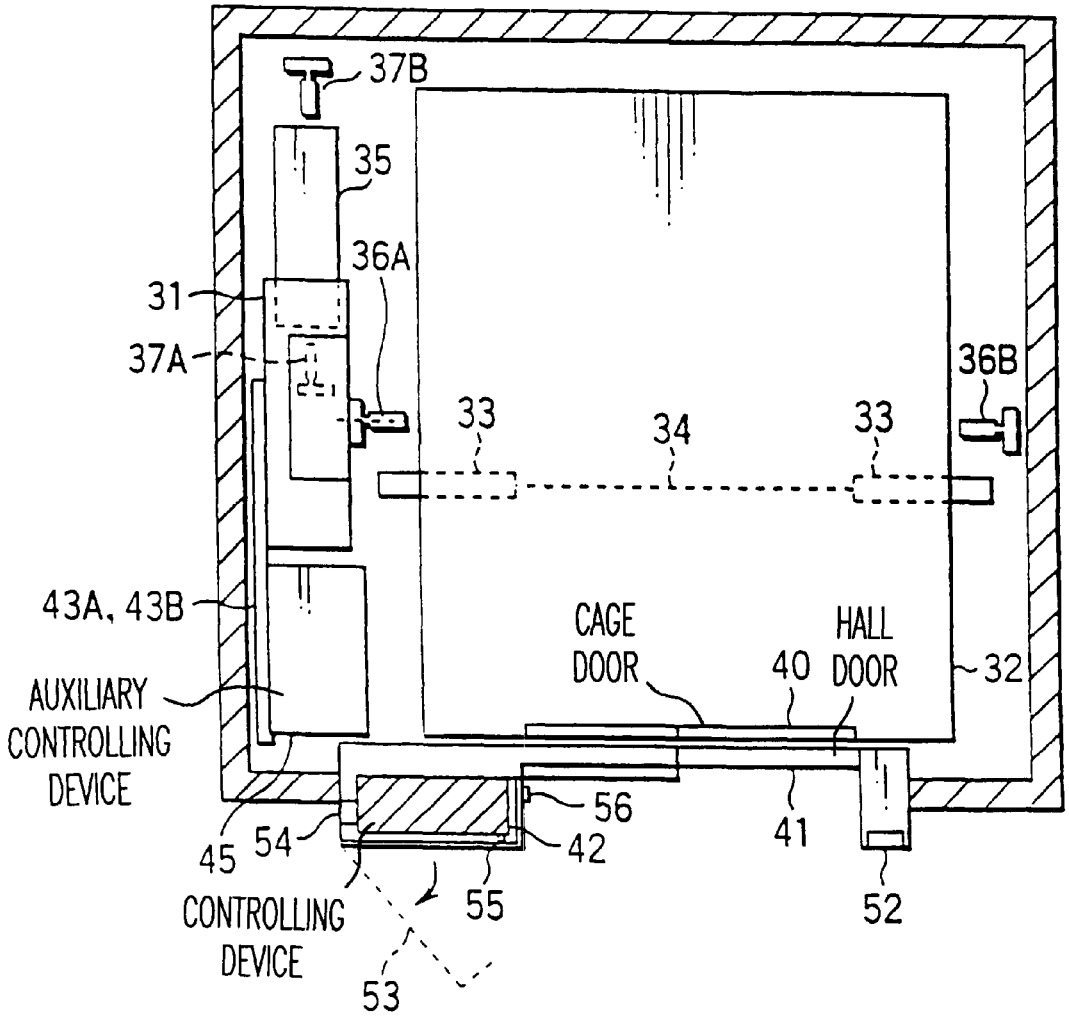
FIG. 6 is a lateral cross-sectional view of the elevator of FIG. 5.

Referring now to the drawings, wherein like reference numerals designate identical or corresponding parts throughout the several views, and more particularly FIGS. 5 and 6 thereof, FIGS. 5 and 6 show an elevator of a first embodiment of the present invention.

In this first embodiment, an auxiliary controlling device 45 is fixed with supporting members 43A, 43B to a guide rail 36A, as an elevator component provided in the vicinity of a door pocket 71 at the upper left side of a hoisting device 31 provided at the top part of the elevator shaft. The auxiliary controlling device 45 includes at least one auxiliary functionality, such as an automatic landing device at the time of a service interruption, a display control device for a monitor watching operation of the elevator, a transformer for the air conditioner power source, and an earthquake sensor, not provided by the controlling device 42.

The supporting members 43A, 43B will be explained in detail. A bolt part is formed in the guide rail 36A provided in the shaft for fixing the hoisting device 31. In this embodiment, the auxiliary controlling device 45 is mounted utilizing the bolt part. That is, one end of the supporting members 43A, 43B is fixed to the bolt part of the guide rail 36A. The two supporting members 43A, 43B extend horizontally outward from the vertically extending guide rail 36A, and support the auxiliary controlling device 45 with a separation distance provided between the surface of the shaft and the auxiliary controlling device 45. By having at least the lower supporting member 43B in an L-shape among the two upper and lower supporting members 43A, 43B, the auxiliary controlling device 45 can be held thereby so that the auxiliary controlling device 45 can be mounted easily with the supporting member 43B.

By welding a nut of about 20 mm to both upper and lower supporting members 43A, 43B in advance, the auxiliary controlling device 45 can be mounted easily. As the supporting members 43A, 43B, a steel plate of about 1 m length, 5 mm thickness and 20 mm width can be used with a sufficient strength for an elevator with a 6 person capacity.

Furthermore, +here is a risk of generating noise by the contact of the auxiliary controlling device 45 and the shaft wall by the vibration of the guide rail 36A. In order to prevent noise generation, it is preferable to have at least a 10 mm distance between the auxiliary controlling device 45 and the wall. However, since generally a rail bracket is mounted to the uppermost part of the guide rail 36A, the vibration of the guide rail 36A is constrained by the bracket and thus the vibration of the guide rail 36A is not considered problematic.

In the first embodiment, the auxiliary controlling device 45 is installed utilizing the space in the vicinity of the guide rail 36A between the cage 32 and the wall of the shaft, and using the bolt part preliminarily formed in the guide rail 36A while paying attention to the guide rail 36A as an elevator component provided in the vicinity of the door pocket 71.

Therefore, in installing the auxiliary controlling device 45, the space can be used effectively, and a new fixing member or elevator component is not needed in the shaft.

Moreover, since the auxiliary controlling device 45 is installed at a position equivalent to that of the hoisting device 31 in the first embodiment, a maintenance worker can conduct maintenance work for the auxiliary controlling device 45 and the hoisting device 31 at the same time, and thus it is advantageous that the maintenance work can be conducted efficiently.

A second embodiment of the present invention will be explained with reference to FIGS. 7 and 8. In this embodiment, the auxiliary controlling device 45 is supported and fixed further by a supporting member 44 in addition to the supporting members 43A, 43B of the first embodiment. Therefore, attention is paid to the guide rail 36A as an elevator component provided in the vicinity of the door pocket 71 in this embodiment as well. In this embodiment, a power source line of, for example, 100 VAC is supplied to the auxiliary controlling device 45 from the hoisting device 31 side via the supporting members 43A, 43B, and a signal line is supplied to the auxiliary controlling device 45 from the hoisting device mounting base 47 via the supporting member 44. This can be determined by the positional relationship among the above-mentioned power source line and signal line and the power source of the hoisting device 1 (that is, the motor power line) because it is preferable that the above-mentioned power source line and the motor power line to be supplied to the hoisting device 31 are placed at the same place since the motor power line is placed from the controlling device 42 via the guide rail 36A.

On the other hand by gathering signal lines at the hoisting device mounting base 47 via the counter weight guide rail 37A and supplying a signal from the supporting member 44 to the auxiliary controlling device 45, the electric lines can be separated.

Moreover, the supporting member 44 contributes not only to the placement of the signal lines but also to increasing the strength of mounting the auxiliary controlling device 45 by being provided slantwise from the hoisting device mounting base 47 (fixed at one end with a bolt, and the like) in addition to the supporting members 43A, 43B provided only from the rail in the first embodiment. Furthermore, since the supporting member 44 is not provided for directly supporting the auxiliary controlling device 45, a steel plate of about 2 mm thickness has sufficient strength, unlike the supporting members 43A, 43B made of a 5 mm thick steel plate. It is preferable to have mounting holes for fixing the signal lines with about 30 cm interval therein.

On the other hand, substrates to be controlled by the serial transmission cable 67 are stored in the auxiliary controlling device 45. This is an appliance for extending the signal input buffer 65 and the signal output buffer 66. The number of substrates can be changed according to the building specification.

Figure 7:
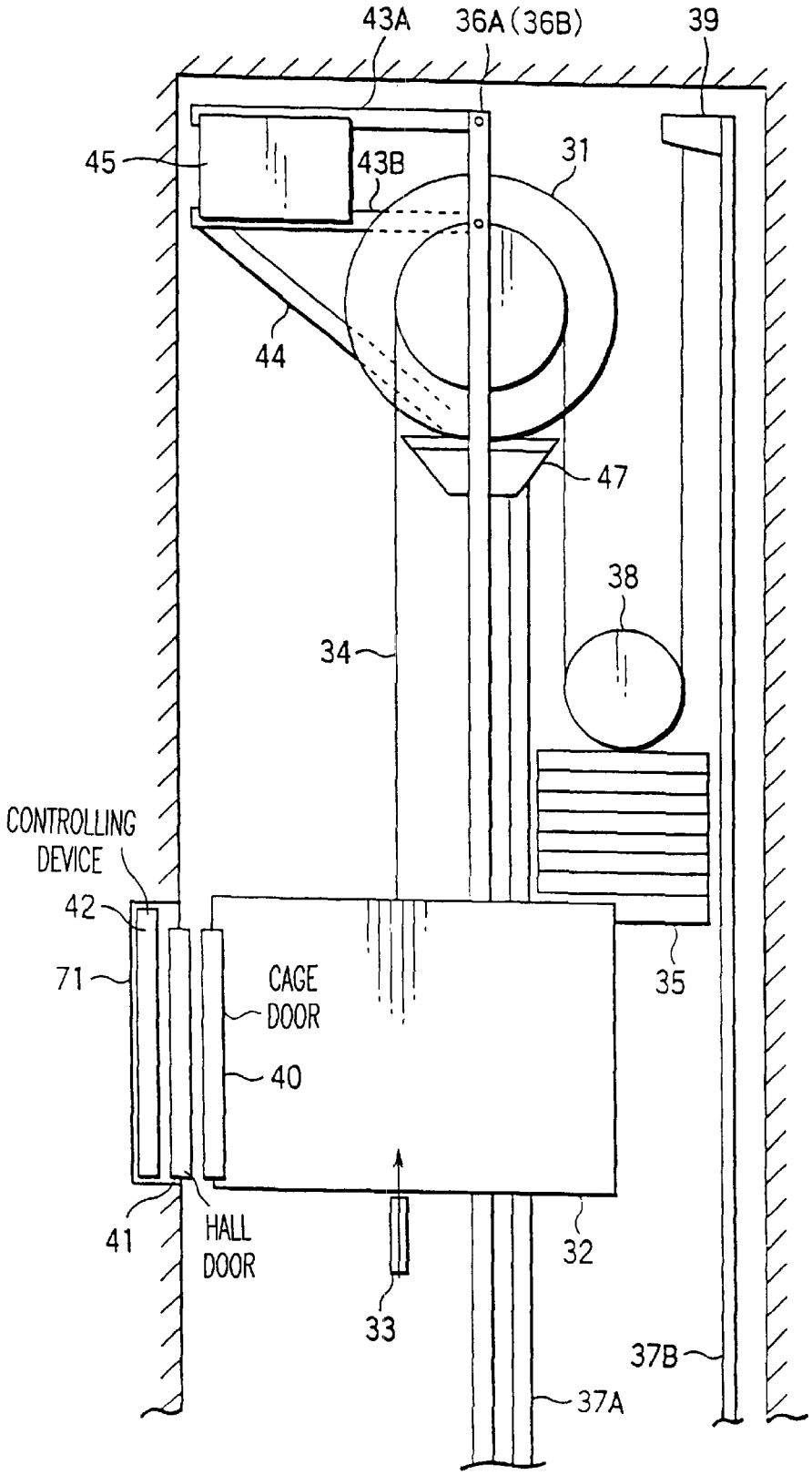
FIG. 7 is a longitudinal cross-sectional view of an elevator of a second embodiment of the present invention.
Figure 8:
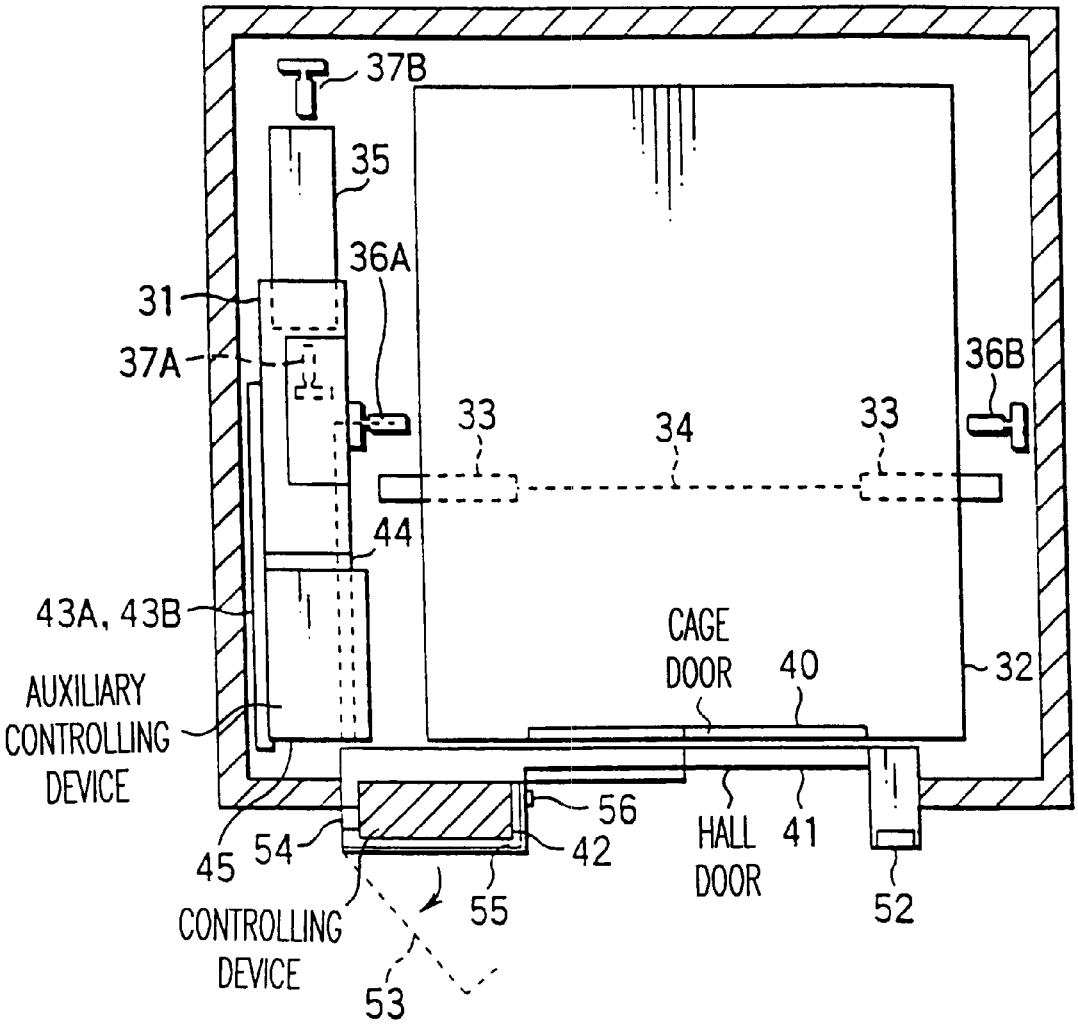
FIG. 8 is a lateral cross-sectional view of the elevator of FIG. 7.

The second embodiment of FIGS. 7 and 8 is particularly advantageous for storing a circuit using a serial transmission in the auxiliary controlling device 45.

A third embodiment of the present invention is next explained with reference to a longitudinal cross-sectional view of the elevator shown in FIG. 9, a lateral cross-sectional view of the elevator shown in FIG. 10, and the detailed illustration of the installation shown in FIG. 11. In this embodiment, attention is paid to the cage guide rail 36A and the counter weight guide rail 37A as elevator components provided in the vicinity of the door pocket 71.

Figure 9:
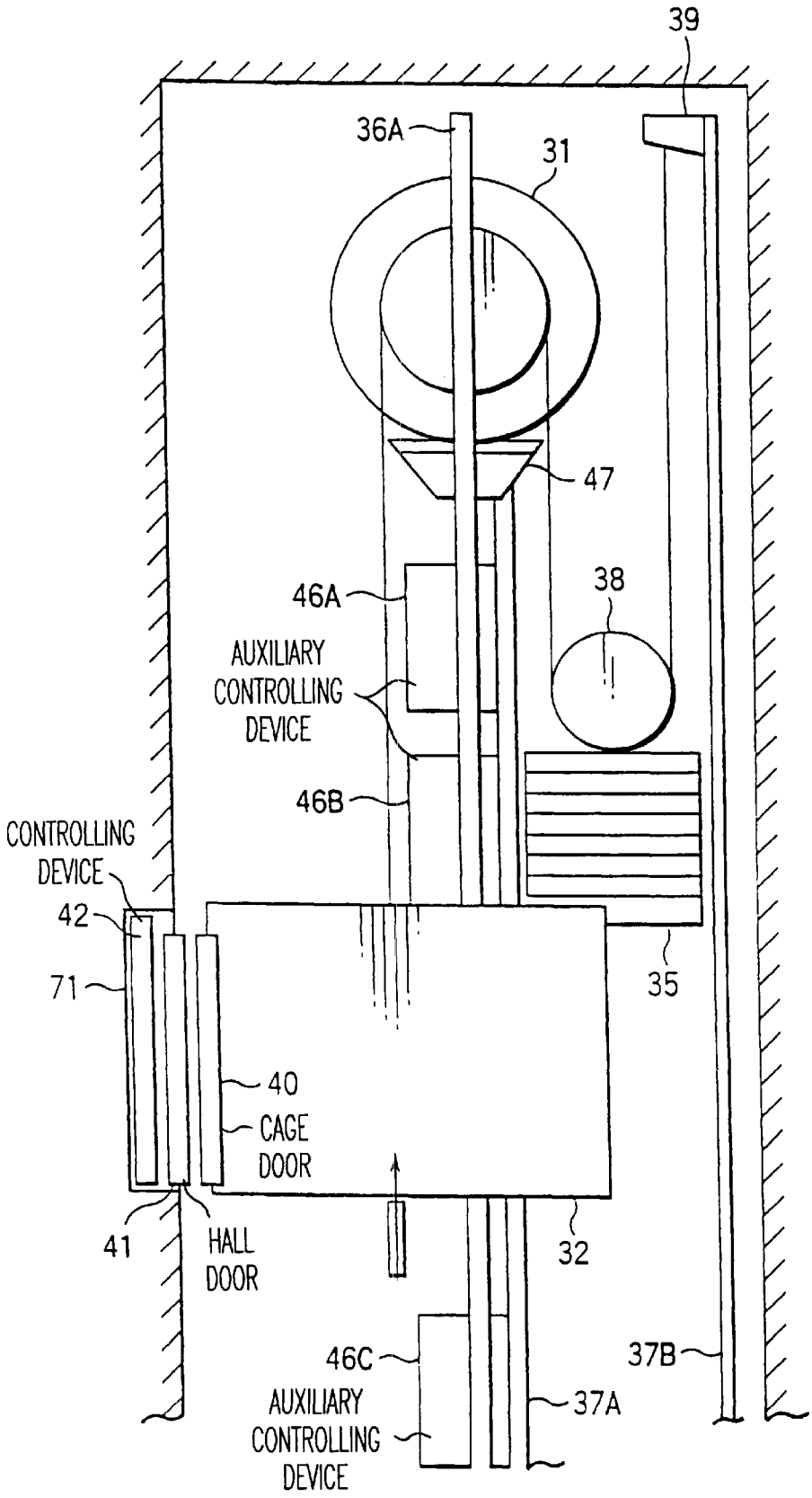
FIG. 9 is a longitudinal cross-sectional view of an elevator of a third embodiment of the present invention.
Figure 10:
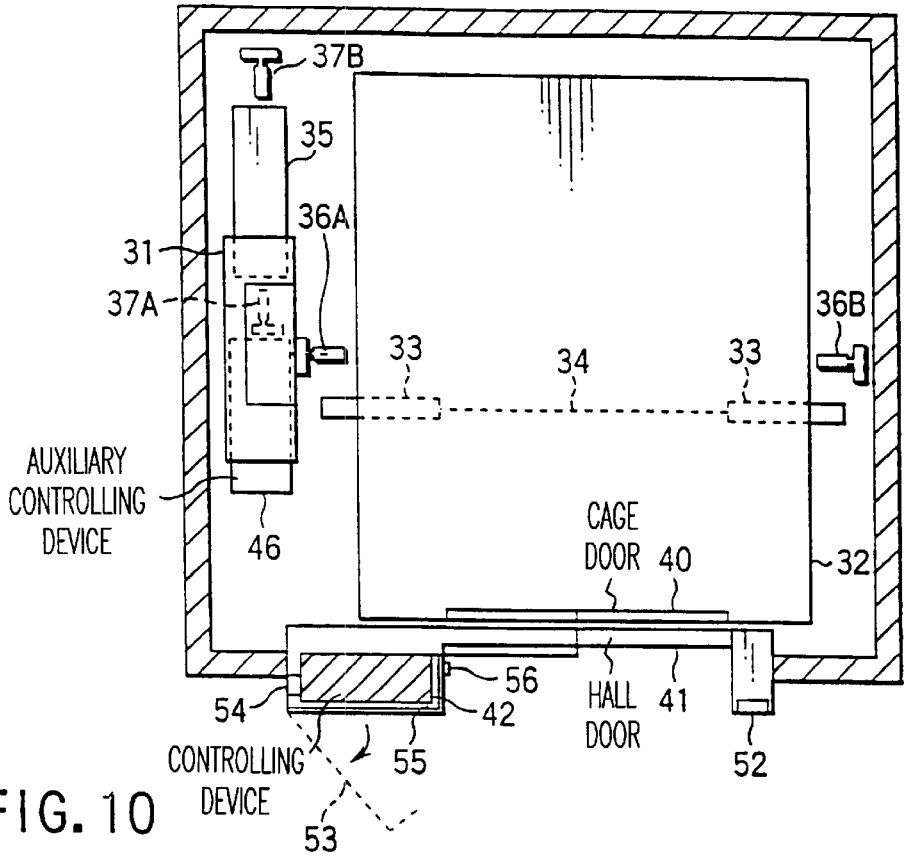
FIG. 10 is a lateral cross-sectional view of the elevator of FIG. 9.
Figure 11:
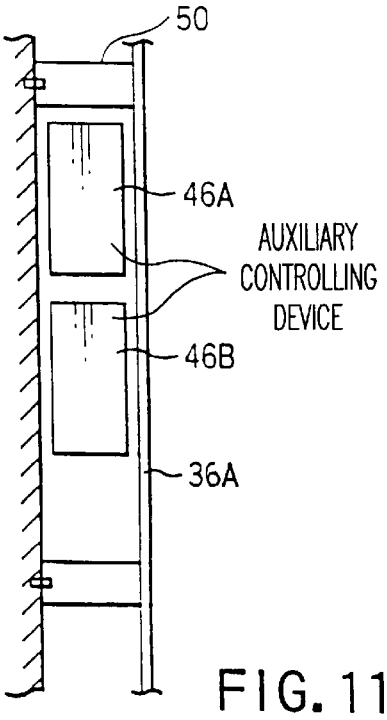
FIG. 11 is a longitudinal side view showing installation of the auxiliary controlling device of FIGS. 9 and 10.

In FIGS. 9 to 11, a space for installing the hoisting device 31 exists between the cage guide rail 36A and the wall surface of the shaft. In this embodiment, the auxiliary controlling devices 46A, 46B, 46C are provided in this space. That is, the auxiliary controlling devices 46A, 46B are provided on the guide rail 36A at locations other than the locations of rail brackets 50. Since the rail brackets 50 are provided generally at 5 m intervals along guide rail 36A, if the length of each auxiliary controlling device 46A, 46B, 46C with respect to the shaft direction is 1 m, 3 to 4 auxiliary controlling devices can be stored between rail brackets 50. The length of the rail brackets between the guide rail 36A and the surface of the shaft is 15 cm.

According to the third embodiment, a large number of auxiliary controlling devices 46 can be installed, compared with the first and second embodiments where the auxiliary controlling device is installed at the top part of the shaft. Therefore, it is advantageous that the auxiliary controlling devices 46A, 46B can be allotted depending on the appliances to be stored. That is, an auxiliary controlling device according to the characteristics of the appliances to be installed, such as a resistor generating heat, a transformer for converting electric power, and a serial transmission circuit plate, can be provided so that a plurality of appliances can be separated according to their characteristics.

Next described is a fourth embodiment of the present invention.

The fourth embodiment is basically configured the same as the third embodiment except that the attachment of the auxiliary controlling device to the guide rail is improved.

Figure 12:
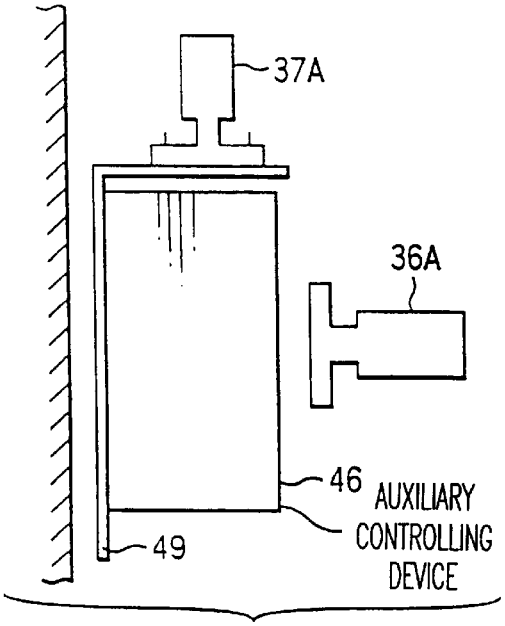
FIG. 12 is a plan view showing installation of an auxiliary controlling device of a fourth embodiment of the present invention.

FIG. 12 is a plan view showing the details of the attachment. In FIG. 12, a space surrounded by the cage guide rail 36A, the counter weight guide rail 37A and the shaft has a size of only about 200 mm by 200 mm and thus if the auxiliary controlling device 46 is fixed to the rails 36A, 37A directly, it is problematic in that the maintenance check and replacement thereafter may be difficult.

In order to prevent the problem, in this embodiment, one end part of an L-shaped supporting member 49 is mounted to the counter weight guide rail 37A with a bolt, or the like, and the auxiliary controlling device 46 is fixed to the other end part side of the supporting member 49 by some means.

According to this configuration, a maintenance worker can check the auxiliary controlling device 46 from the cage 32 toward the direction of the guide rail 36A, and thus it is effective for preventing the above-mentioned problem.

Figure 13:
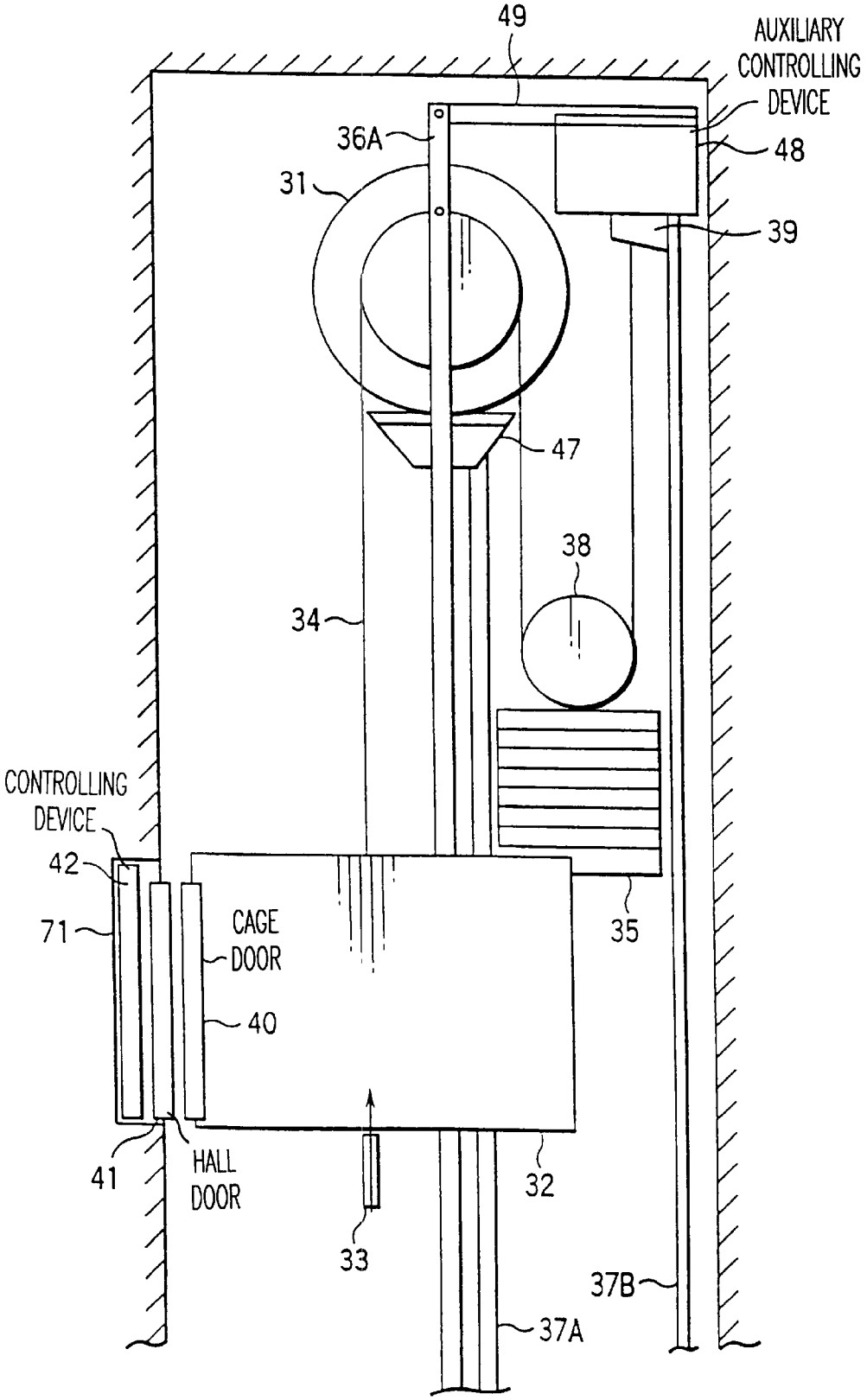
FIG. 13 is a longitudinal cross-sectional view of an elevator of a fifth embodiment of the present invention.

A fifth embodiment will be explained with reference to a longitudinal side view of the elevator shown in FIG. 13. In the fifth embodiment, the counter weight cable hitch 39 is provided lower than usual, with an auxiliary controlling device 48 mounted on the hitch 39. Similar to the first embodiment, one end part of the supporting member 49 is fixed to the uppermost end of the guide rail 36A, and the auxiliary controlling device 48 is fixed to the other end side of the supporting member 49. Since the strength of the supporting member 49 is weaker than the guide rail 36A, it is effective to support the weight of the auxiliary controlling device 48 at the top part of the guide rail 36A for maintaining the strength of the supporting member 49.

It is preferable to place an appliance using a battery such as an automatic landing device at the time of the service interruption in the auxiliary controlling device 48.

Since the auxiliary controlling device 48 can be stored with the cable hitch part 39 in the fifth embodiment, an effect of improving the appearance of the top part of the shaft can be achieved as well.

Although explanation has been given in the first to fifth embodiment that the auxiliary controlling device 48 is for storing an appliance having at least one of the auxiliary controlling appliances such as an automatic landing device at the time of the service interruption, a display control device for monitor, a transformer for the air conditioner power source, and an earthquake sensor, a maintenance operation device 100 explained later in the sixth embodiment can also be stored.

The sixth embodiment of the present invention is explained with reference to FIGS. 14 and 15.

Figure 14:
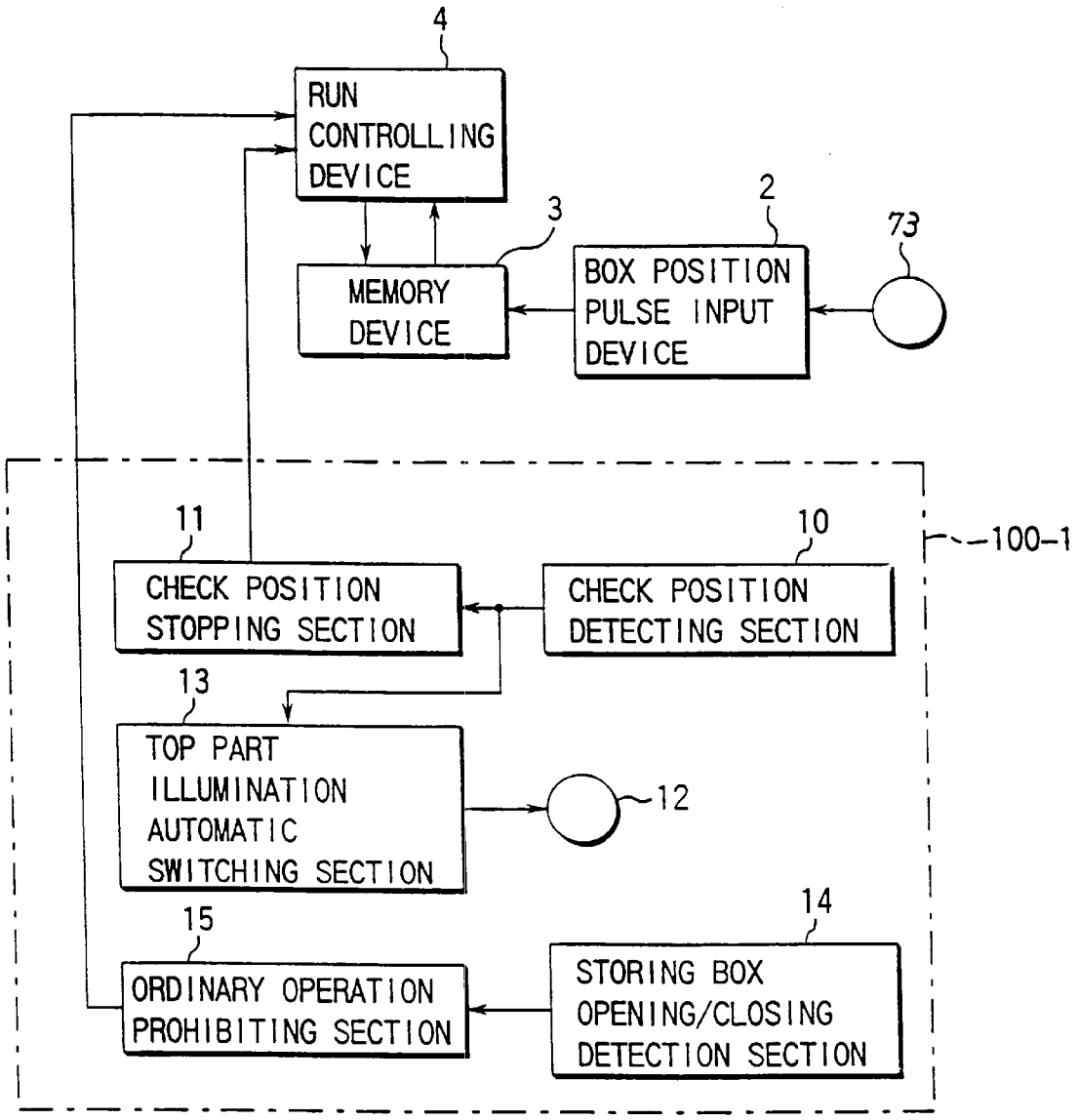
FIG. 14 is a schematic block diagram of a sixth embodiment of the present invention.

FIG. 14 is a block diagram showing the configuration of an elevator controlling system according to the sixth embodiment of the present invention. In the sixth embodiment, a run controlling device 4 is the main device for controlling the operation of the elevator. The run controlling device 4 operates the elevator while confirming the existence of the cage call or the elevator hall call through the memory device 3, and stores data on the run state of the elevator in the memory device 3. Detection of the cage position can be conducted by the output from the pulse generator 73 outputted in proportion to the rotation of the hoisting device 31. A detection signal from the pulse generator 73 is sent to the memory device 3 via the pulse input device 2 so as to be stored regularly therein.

In the sixth embodiment of the present invention, a maintenance operation device 100-1 is added to the elevator with the above-mentioned embodiments. The maintenance operation device 100-1 is stored in either the controlling component box A or the controlling component box B later described.

The maintenance operation device 100-1 includes a check position detecting section 10 which detects whether a pulse of the present position of the cage approaches to the installation place pulse value of the controlling component boxes A and B, a check position stopping section 11 for stopping the elevator if the check position detecting section 10 is operated in the on-cage check operation to be conducted on the cage, a shaft top part illumination 12 for lighting the controlling component box, and the like, related to the hoisting device 31 having an 100 VAC incandescent lamp, and the like, a top part illumination automatic switching section 13 for automatically switching on the top part of the shaft illumination 12 when the check position detecting section 10 is operated, a storing box opening and closing section 14 having a switch, and the like, mounted on the cage opening and closing part, later described, for detecting the opening and closing state of the controlling component box later described, and an ordinary operation prohibiting section 15 for prohibiting ordinary operation running while the controlling component box is opened.

Figure 15A:
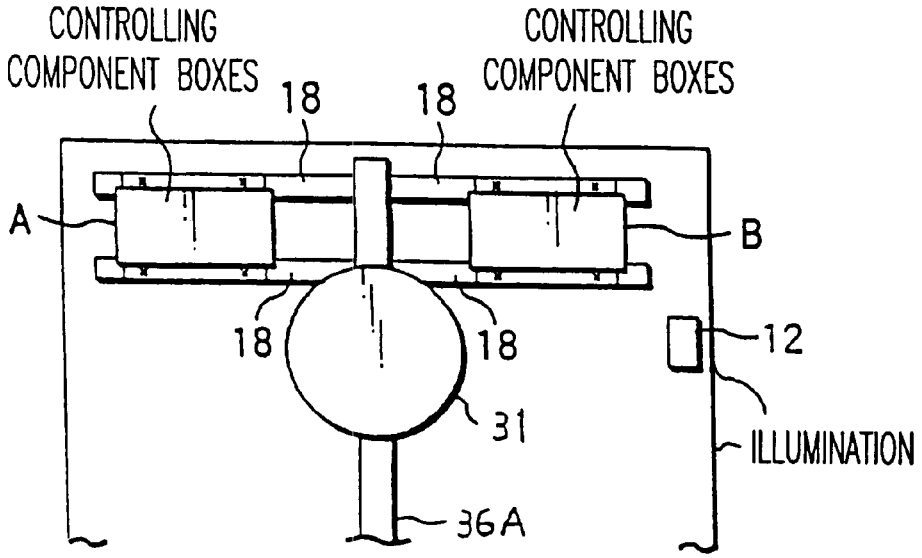
FIGS. 15A and 15B are illustrations for explaining the configuration of FIG. 14 in the shaft.
Figure 15B:
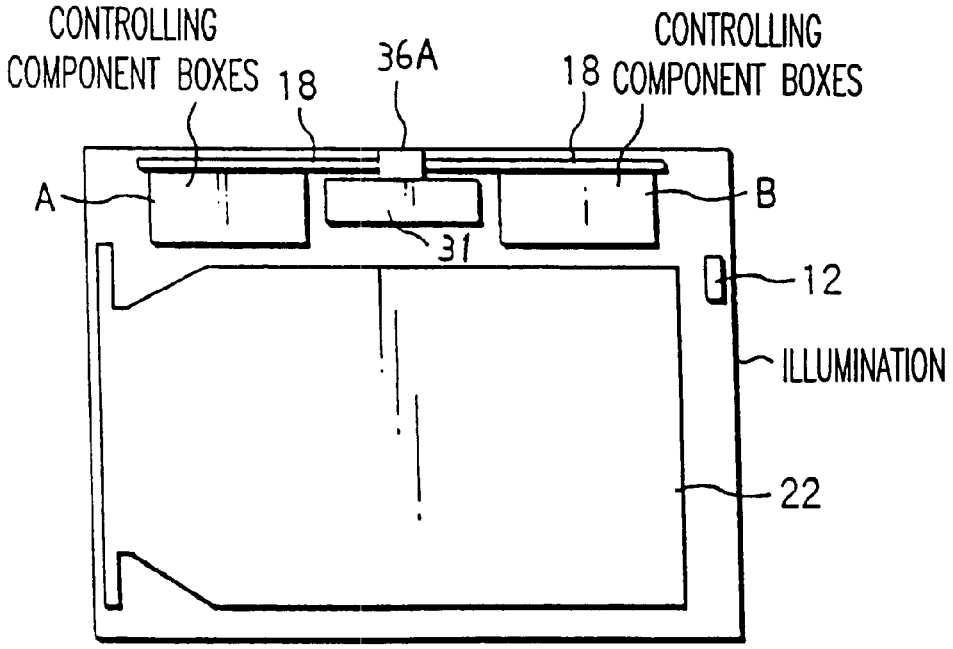

FIGS. 15A and 15B are diagrams for explaining the inside of the shaft in this embodiment. FIG. 15A is a side view of the side where the hoisting device 31 is installed, and FIG. 15B is a plan view of the shaft viewed from the ceiling. Two cage installation fixing brackets 18 are mounted to the top part of the guide rail 36A installed with the hoisting device 31. The brackets 18 are positioned horizontally from the guide rail 36A. A controlling component box A and a controlling component box B are fixed to the installation fixing brackets 18. Both boxes A, B are placed in the cross-sectional space in the shaft excluding the projection plane of the cage 32.

In this embodiment, attention is paid to the guide rail 36A mounted with the hoisting device 31 as an elevator component installed in the vicinity of the door pocket 71 so that the controlling component boxes A, B are fixed with the two installation fixing brackets 18 provided on the guide rail 36A. The maintenance operation device 100-1 is stored in the controlling component boxes A, B. However, an appliance having, at least one auxiliary controlling device, such as an automatic landing device at the time of the service interruption, a display control device for monitor, a transformer for the air conditioner power source, and an earthquake sensor, other than the run controlling device 4 explained in the first to the fifth embodiments, can also be stored therein.

According, to the sixth embodiment, when maintenance workers inspect the controlling component boxes A and B riding on a roof of the cage, the cage can be stopped automatically at a place convenient for checking the controlling device installed in the shaft, and further, the security in the checking, operation for the controlling device in the shaft can be improved.

Figure 16:
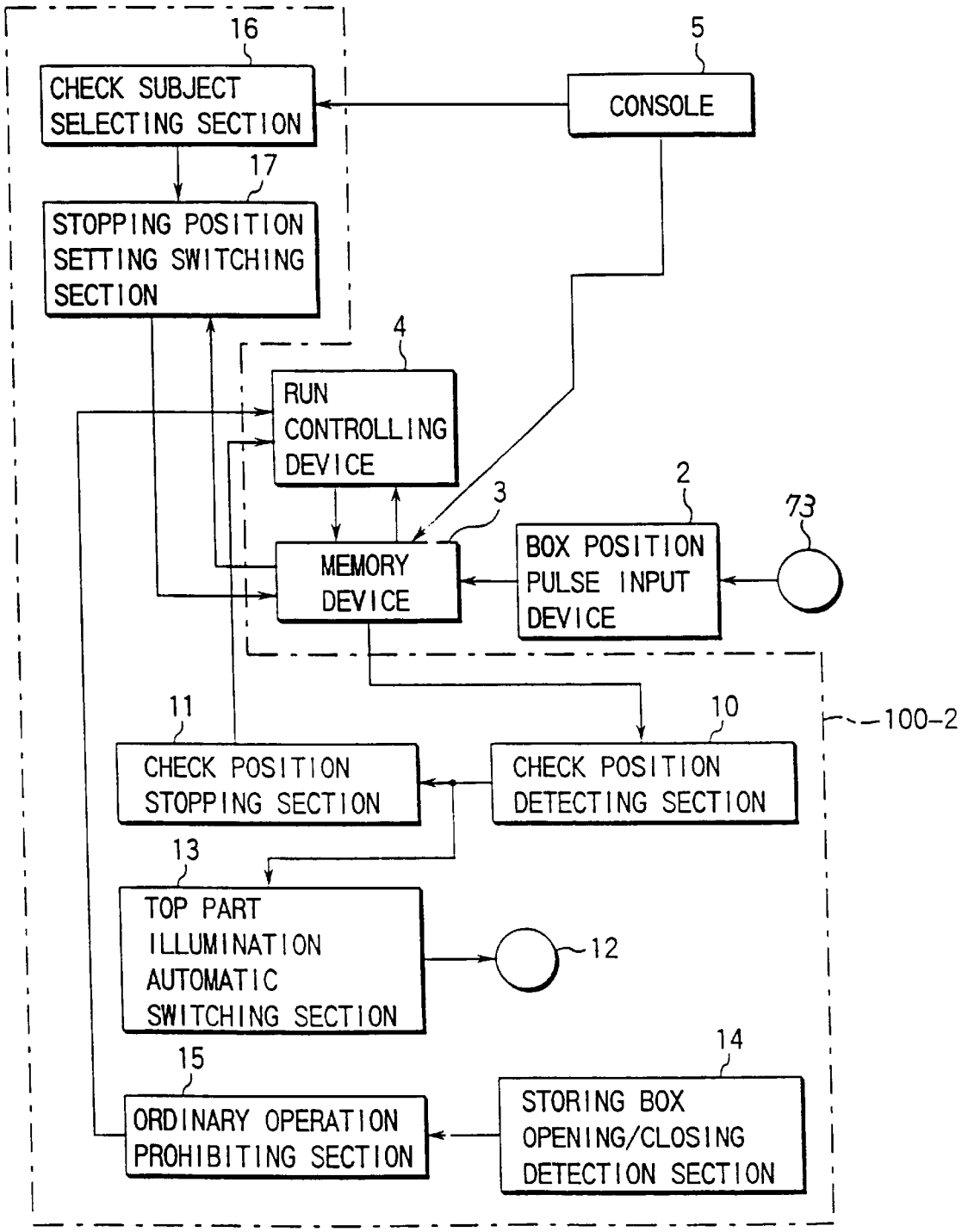
FIG. 16 is a schematic block diagram of a seventh embodiment of the present invention.

FIG. 16 is a block diagram showing the configuration of the elevator controlling system according to a seventh embodiment of the present invention. In this embodiment, a maintenance operation device 100-2 stored in the controlling component boxes A, B, is provided. Device 100-2 includes a controlling component check subject selecting section 16 for selecting the controlling component box to be the subject of the check from data in the memory device 3 by the operation of the maintenance data storing device such, as a console 5, and a stopping, position setting switching section 17 for resetting the stopping position data set in the memory device 3 to a detecting position appropriate for checking the controlling component box selected by the console 5 via the check subject selecting section 16.

Figure 17:
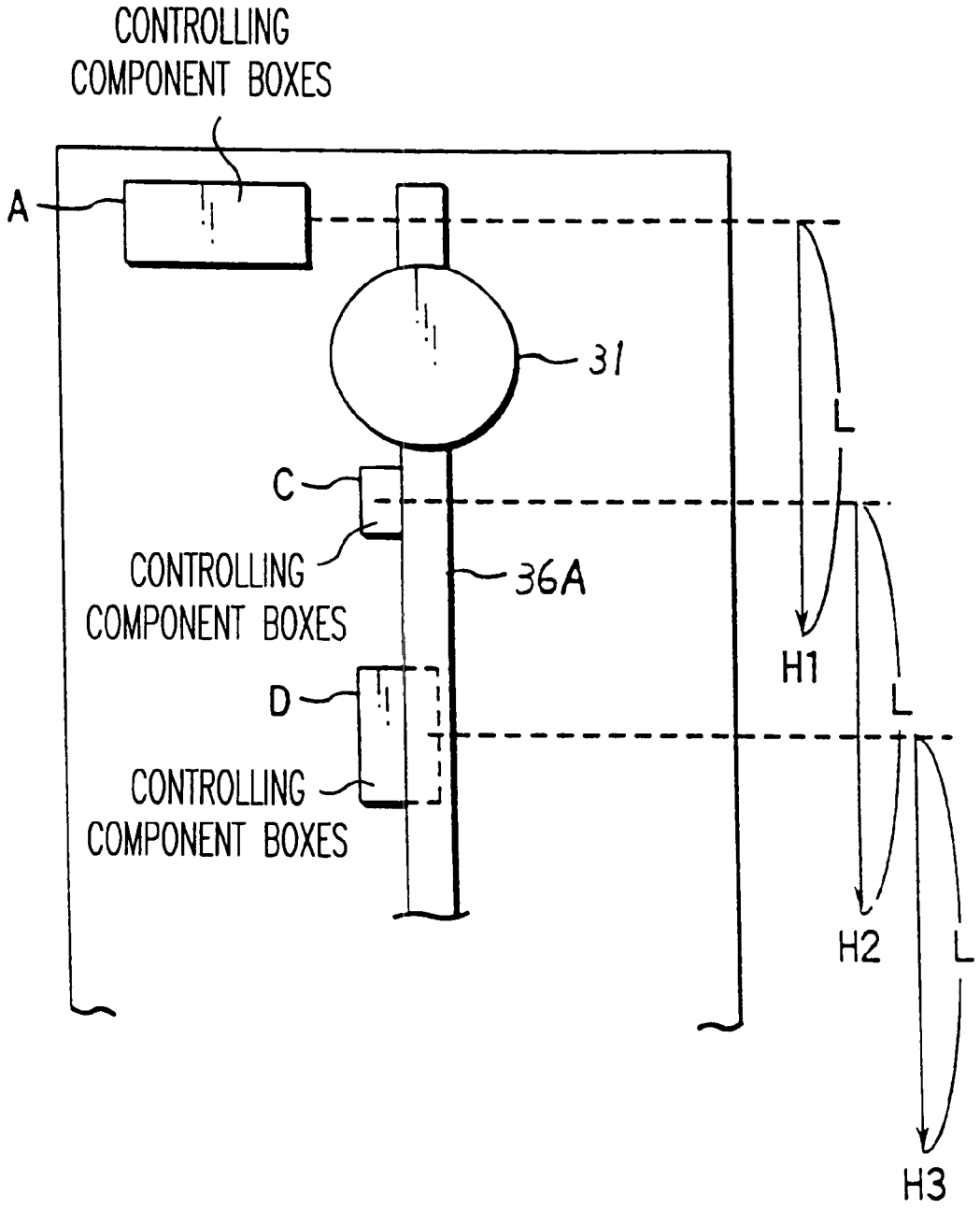
FIG. 17 is a schematic illustration for explaining the change of the stopping position depending on the selected controlling component box.

FIG. 17 shows the changing state of the stopping position according to the selected controlling component box. In FIG. 17, the mark A represents the controlling component box A, the designation C represents the controlling component box C, and the designation D represents the controlling component box D. The designation L represents the set length from the controlling component boxes A, C, D to the cage stopping position. The designation H1 represents the cage upper end stopping position when the controlling component box A is selected. The designation H2 represents the cage upper end stopping position when the controlling component box C is selected. The designation H3 represents the cage upper end stopping position when the controlling component box D is selected.

That is, if the controlling component box A is selected, the position H1 with the cage upper end below the controlling component box A by the length L is set as the stopping position. The length L is generally set at about 1300 mm.

The data can be set by the memory device 3. For example, in the case of 1300 mm, with a 1 mm/pulse pulse value, 0514H (hexadecimal notation) is stored.

Similarly, if the controlling component box C is selected, the position H2 is set as the stopping position, and if the controlling component box D is selected, the position H3 is set as the stopping position accordingly.

According to this embodiment, the cage can be stopped at a position appropriate for the check even when the controlling component boxes are provided at plural spots. Since a maintenance worker needs to operate the elevator while stooping because a space sufficient for the maintenance work cannot be secured at the top part of the shaft, an extremely advantageous means can be provided by allowing the automatic stoppage.

Figure 18:
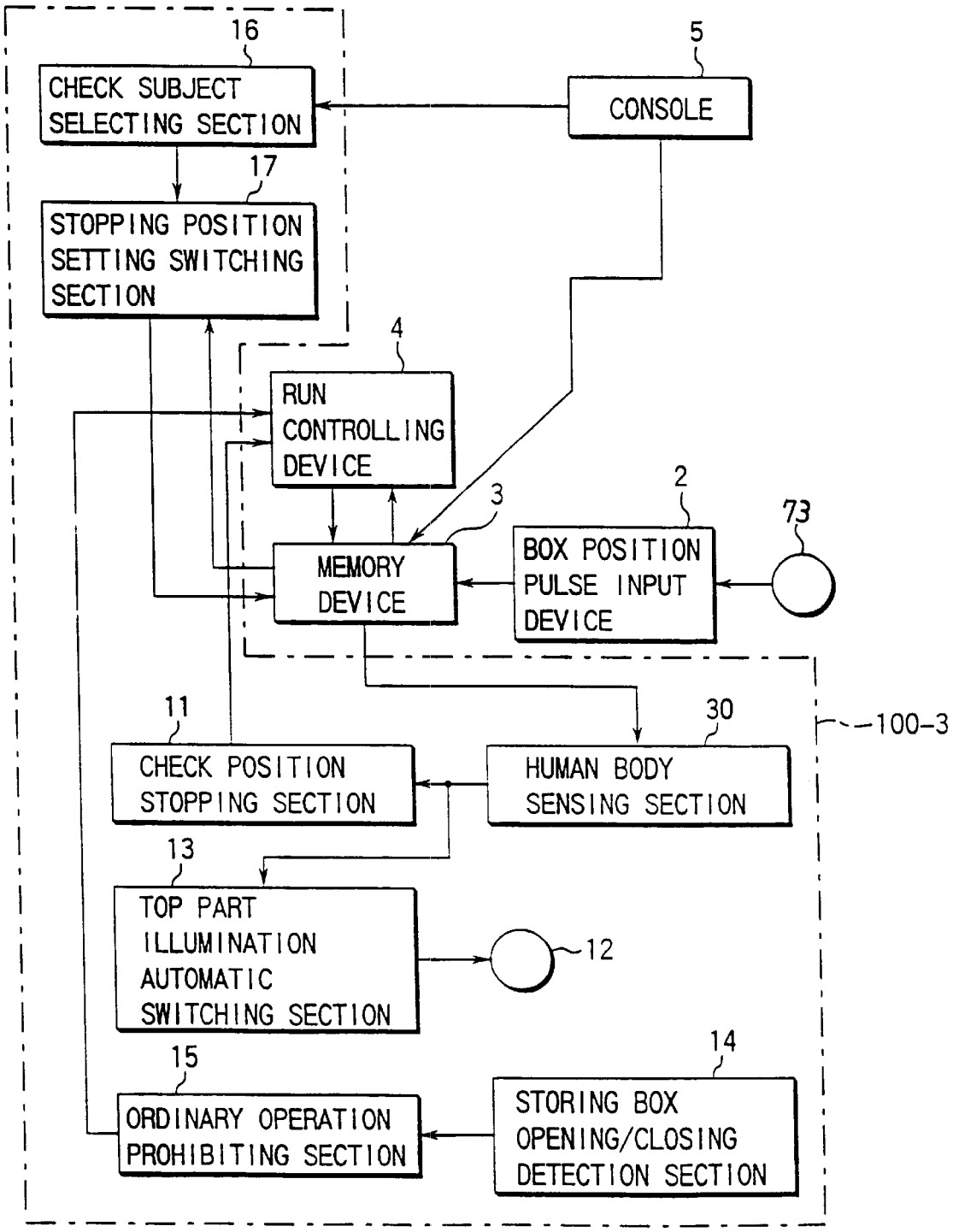
FIG. 18 is a schematic block diagram of an eighth embodiment of the present invention.

FIG. 18 is a controlling block diagram showing an eighth embodiment of the present invention. A maintenance operation device 100-3 is provided by provided a human body sensing section 30 having a heat sensor in place of the controlling component check position detecting section 10 in FIG. 16. The maintenance operation device 100-3 is stored in the controlling component box.

Since the temperature in the shaft is high so that an ordinary switch may be operated mistakenly, the maintenance operation device 100-3 according to this embodiment employs a heat sensor as the human body sensing section 30.

According to the configuration of this embodiment the above-mentioned mistaken operation can be prevented, and furthermore, the effect of the embodiment shown in FIG. 17 can be achieved That is, the cage can be stopped automatically at a position convenient for the check of the controlling component box installed in the shaft as well as the security in the checking operation for the box in the shaft can be improved.

Although an example with the auxiliary controlling device 45 mounted at the cage door 40 side with respect to the hoisting device 31 is shown in the first embodiment, it can be mounted on the opposite side with respect to the cage door 40.

Moreover, although an example with the auxiliary controlling device 45 mounted with the supporting member 43 with one end part fixed to the cage guide rail 36 is shown in the first embodiment, it can be fixed directly to the cage guide rail 36 with a bolt, or the like, without using the supporting member 43.

In an embodiment without using the supporting member 43, since a signal line or a power source line cannot be placed by utilizing the supporting member 43, they need to be installed on the guide rail as in the prior art.

Although a configuration where the supporting member 44 is installed from the hoisting device mounting base 47 is shown in the second embodiment, the supporting member 44 can be provided directly from the controlling device 42. In this case, since a signal line can be placed directly from the controlling device 42, an improved effect can be achieved compared with the second embodiment. Moreover, it is also advantageous in that the supporting member 44 can be used for mounting a maintenance appliance for the hoisting device 31 or a sound proof device.

Although a configuration where a plurality of the auxiliary controlling devices 46 are provided below the hoisting device 31 is shown in the third embodiment, it is also possible that a long auxiliary controlling device 46 is provided between rail brackets such that the internal appliances are changed depending on the building specification.

Although a configuration where the supporting member 49 is placed at the rear surface of the counter weight guide rail 37A is explained in the fourth embodiment, it is also possible to fix the supporting member from the cage guide rail 36A. Moreover, it is also possible to fix the supporting member 49 from the rail bracket 50. The supporting member 49 is not necessarily L-shaped but can also have a configuration pulled horizontally from the cage guide rail 36A. In this case, n general, the auxiliary controlling device 46 is stored between the rails such that the auxiliary controlling device 46 can be pulled horizontally beside the cage guide rail 36A at the time of the maintenance work.

Moreover, although an example with the detecting position of the elevator as the output value from the pulse generator is explained in the sixth to eighth embodiments, it is also possible to detect the position of the elevator by providing a switch or a light detector at an optional position as needed.

Numerous additional modifications and variations are also possible. It is therefore to be understood that within the scope of the pending claims, the present invention may be practiced other than as specifically described herein.

What is claimed as new and desired to be secured by Letters Patent of the United States is:

1. An elevator comprising:

a hoisting device configured to drive a cage installed in a shaft, a counter weight installed in the shaft, a cable configured to connect said counter weight and said cage via said hoisting device, a guide rail configured to guide said cage or said counter weight vertically, a controlling device installed in a door pocket provided at a certain elevator hall and configured to control the operation of said cage, an auxiliary controlling device configured to operate an auxiliary function of said controlling device, provided in the vicinity of an elevator component provided in the vicinity of said door pocket of said elevator hall, where said controlling device is installed; and a maintenance operation device including a detecting unit configured to detect whether said cage has approached to a position by a certain distance from a mounting position of said auxiliary controlling device, and a stopping unit configured to stop said cage when said detecting unit is operated.

2. The elevator according to claim 1, wherein said elevator component is one of said guide rail, said hoisting device, and a cable hitch provided above said guide rail.

3. The elevator according to claim 1, further comprising:

a plurality of supporting members fixed to said guide rail or said hoisting device and configured to fix said auxiliary controlling device and to install a power source line and a signal line.

4. The elevator according to claim 1, wherein said auxiliary controlling device is at least one of an automatic landing device at the time of the service interruption, a display control device for a monitor watching operation of said cage, a transformer for the air conditioner power source, and an earthquake sensor.

5. The elevator according to claim 1, wherein said maintenance operation device further comprises:

an illuminating unit configured to light up a top part of said shaft; and an automatic switching configured to automatically switch on said illuminating unit when said detecting unit is operated.

6. The elevator according to claim 1 wherein said maintenance operation device comprises:

selecting means for selecting said auxiliary controlling device to be the subject of a check; and stopping position setting means for setting a detecting position appropriate for checking the selected auxiliary controlling device.

7. The elevator according to claim 1, wherein said detecting unit comprises:

a human body sensing unit provided in a top part of said shaft or in said auxiliary controlling device and configured to sense the approach of a human body.

8. The elevator according to claim 7, wherein said maintenance operation device comprises:

an illuminating unit configured to light up the top part of said shaft, and an automatic switching unit configured to automatically switch on said illuminating unit when said human body sensing unit senses the approach of a human body.

9. The elevator according to claim 1, wherein said maintenance operation device comprises:

an opening and closing detecting unit configured to detect the opening and closing state of said auxiliary controlling device; and an operation prohibiting unit configured to prohibit an ordinary operation while said auxiliary controlling device is opened.

10. An elevator comprising:

a hoisting device configured to drive a cage installed in a shaft;

a counter weight installed in said shaft;

a cable configured to connect said counter weight and said cage via said hoisting device;

a guide rail configured to guide said cage or said counter weight vertically;

a controlling device installed in a door pocket provided at a certain elevator hall and configured to control the operation of said cage;

an auxiliary controlling device configured to operate an auxiliary function of said controlling device, provided at a rear surface of said guide rail: and a supporting member longer than the width of said guide rail provided at a rear surface of said guide rail and configured to fix said auxiliary controlling device.

11. The elevator according to claim 10, wherein said auxiliary controlling device is at least one of an automatic landing device at the time of the service interruption, a display control device for a monitor watching operation of said cage, a transformer for the air conditioner power source, and an earthquake sensor.

12. An elevator comprising:

a hoisting device configured to drive a cage installed in a shaft;

a counter weight installed in said shaft;

a cable configured to connect said counter weight and said cage via said hoisting device;

a cage guide rail configured to guide said cage vertically;

a counter weight guide rail configured to guide said counter weight vertically;

a controlling device installed in a door pocket provided at a certain elevator hall and configured to control the operation of said cage; and an auxiliary controlling device configured to operate the auxiliary function of said controlling device, provided on at least one of a cable hitch installed on said counter weight guide rail and a cable hitch installed on said cage guide rail.

13. The elevator according to claim 12, wherein said auxiliary controlling device is at least one of an automatic landing device at the time of the service interruption, a display control device for a monitor watching operation of said cage, a transformer for the air conditioner power source, and an earthquake sensor.

* * * * *